United States Patent [19]

Warthan et al.

[11] 4,078,643

[45] Mar. 14, 1978

[54] TOKEN OPERATED CONTROL SYSTEM FOR A MULTITRACK TAPE CARTRIDGE PLAYER

[75] Inventors: David Benjamin Warthan, French Camp, Calif.; Roland C. Warthan, Vallejo, Calif.

[73] Assignee: David B. Warthan, French Camp, Calif.

[21] Appl. No.: 701,317

[22] Filed: Jun. 30, 1976

[51] Int. Cl.[2] ..... G07F 5/10

[52] U.S. Cl. ..... 194/15; 360/72

[58] Field of Search ..... 194/12, 15; 360/72, 360/92

[56] References Cited

U.S. PATENT DOCUMENTS 3,707,213 12/1972 Larre ..... 194/15 X 3,860,962 1/1975 Baker ..... 360/92

*Primary Examiner*—Robert B. Reeves

*Assistant Examiner*—Joseph J. Rolla

*Attorney, Agent, or Firm*—Townsend and Townsend

[57] ABSTRACT

A token operated control system for use with a multitrack tape cartridge player which enables a priori manual selection of a single track from one or more tape cartridge players for reproduction and which provides automatic termination of track reproduction at the end of a given track. Interruption of track reproduction, once reproduction has begun, is prevented by the control system circuitry. The control system is compatible with several commercially available eight-track tape cartridge tape players and includes additional circuitry for sequentially arriving at a single track of a given cartridge player unit specified by manual operation of panel switches after the insertion of a token, e.g., a coin.

11 Claims, 4 Drawing Figures

TO RA
TO RB
TO LA
TO LB
FROM 13
FROM 26
12V
A
B
RA
RB
LA
LB

TOKEN OPERATED CONTROL SYSTEM FOR A MULTITRACK TAPE CARTRIDGE PLAYER

BACKGROUND OF THE INVENTION

This invention relates to token operated sound reproducing devices enabling manual selection of program material. More particularly, this invention relates to devices of this type in which the program selections are recorded on magnetic tape housed in a conventional eight-track tape cartridge and are reproduced with a tape player unit.

Coin operated audio reproduction devices are known in which the program material is recorded on conventional eight-track stereo cartridge tape in the form of four pairs of program tracks providing a stereo reproduction capability. Some reproducing devices of this type employ unique electro-mechanical designs which are expensive to fabricate, complex in design, and expensive to service. Some devices require such a large physical size as to be impractical for installation in most locations. Other devices employ a single conventional eight-track tape cartridge player and, while found satisfactory for some applications, suffer from one or more disadvantages which tend to limit their use.

SUMMARY OF THE INVENTION

The invention comprises a token operated control system for use with a multitrack tape cartridge player which enables a priori manual selection of a single track from one or more tape cartridge players for reproduction and which provides automatic termination of track reproduction at the end of a given track. The invention is inexpensive to fabricate, highly reliable in operation, small in size and compatible with a wide variety of commercially available tape cartridge players.

In the preferred embodiment, a first plurality of switches are provided for enabling manual selection of a single one of a plurality of tracks recorded on a standard multitrack tape cartridge and a second plurality of manually operable switches are provided for enabling selection of a given one of a plurality of tape cartridge players. Seek means coupled to a first electrical power input terminal is responsive to the operation of one of the first and second switch means to the ON position for enabling the preselected tape cartridge player to sequentially access the plurality of tracks recorded on the cartridge of the selected cartridge player until the selected track has been accessed. After the specified track has been accessed, reproduction enable means coupled to programming means indicating terminals of the tape cartridge player disables the seek means and applies electrical power from the first electrical power input terminal to the selected tape cartridge player to enable reproduction of the accessed track. After the desired track has been completely reproduced, reset means coupled to the track end indicating means of the cartridge tape player resets the operated one of the first plurality of switch means to the OFF position and disables the first and second plurality of switch means and the reproduction enable means. Token switch means is provided which enables the first and second plurality of switch means, the seek means and reproduction enable means in response to the insertion of a predetermined token therein.

The preferred embodiment further includes a pair of audio transducers for converting the electrical signals from the selected tape cartridge player to audible signals, the transducers including input terminals adapted to be coupled to the tape cartridge players; and the reproduction enable means includes means for coupling the electrical signals from the selected one of the tape cartridge players to the input terminals of the audio transducer.

The preferred embodiment further includes a plurality of tape cartridge player and track indicator lamps for providing a visible indication of the selected tape cartridge player and the selected track after the token has been inserted and the first and second switch means have been manually operated.

The seek means includes means for generating sequential electrical stepping signals for operating the programming means of the selected tape cartridge player, and is arranged in such a manner that track selection must be completed before the selected tape cartridge player is supplied with electrical power from the first electrical power input terminal to begin reproducing the selected track.

The preferred embodiment is further provided with operator signal lamp circuits for indicating that the system is ready for insertion of a new token and that a tape cartridge player and track may be selected.

For a fuller understanding of the nature and advantages of the invention, reference should be had to the ensuing detailed description taken in conjunction with the accompanying drawings.

BRIEF DESCRIPTION OF THE DRAWINGS

FIG. 1 is a circuit schematic illustrating the preferred embodiment of the invention;

DESCRIPTION OF THE PREFERRED EMBODIMENT

Figure 7:
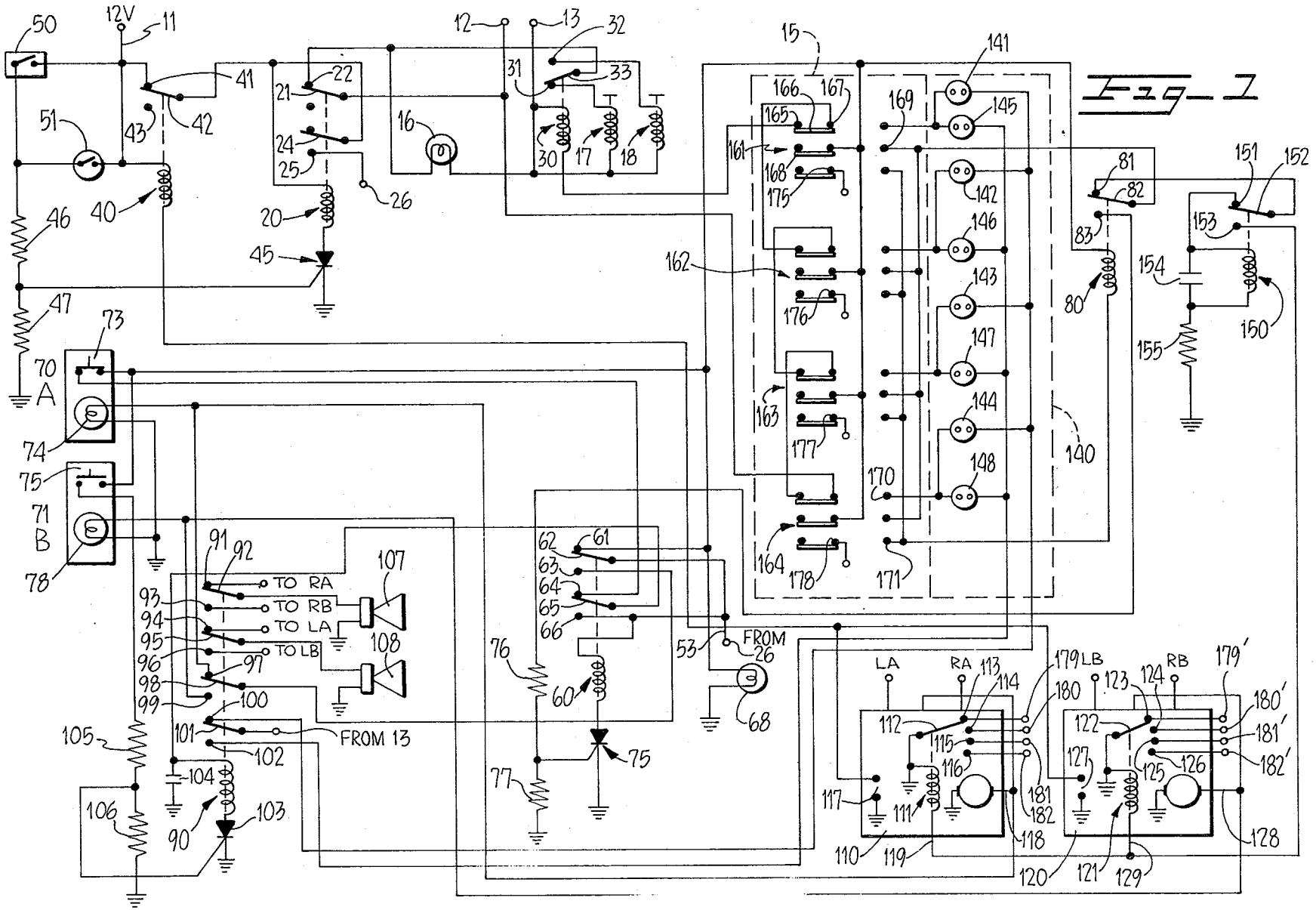

Turning now to the drawings, FIG. 1 shows a circuit schematic of the preferred embodiment of the invention. Electrical power from a suitable source of DC voltage, e.g. 12 volts DC ((not shown), is coupled to a first input terminal 11, while electrical power from a suitable source of AC voltage is coupled to a pair of second input terminals 12, 13. AC power is coupled from terminal 12 to a first plurality of manually operable track selector switches generally designated by reference numeral 15, and also to a first movable contact blade 21 of a relay 20 illustrated in the normally deenergized state. AC terminal 13 is coupled to a first terminal of an indicator lamp 16, the other terminal of which is coupled via a stationary contact blade 22 and movable contact blade 21 of relay 20 to AC terminal 12 so that lamp 16, termed the INSERT COIN lamp, is normally illuminated when power is applied to the circuit. Lamp 16 functions as both a power on indicator and also an indicator that the circuit is ready for operation by the insertion of a token in the manner described below.

AC terminal 13 is also coupled to the first end of a pair of electro-mechanical solenoids 17, 18, hereinafter designated the LOCK and RELEASE solenoids, respectively. The remaining ends of solenoids 17 and 18 are coupled respectively to stationary contact blades 31, 32 of a relay 30 having a movable contact blade 33 normally coupled to AC terminal 12 via stationary blade contact 22 and movable blade contact 21 of relay 20. The coil of relay 30 is normally energized when power is applied to AC terminals 12, 13 via a conductive path provided by switches 15 and described more fully below. When energized, contacts 31 and 33 of relay 30 are connected as shown so that lock solenoid 17 is energized to mechanically lock up switches 15 and thereby prevent their operation.

DC power present at input terminal 11 is normally coupled via stationary contact blade 41 and movable contact blade 42 of a normally deenergized relay 40 to movable contact blade 24 of relay 20 and also to a first end of the coil of relay 20, the other end of which is coupled to the anode of a silicon controlled rectifier 45. The cathode of rectifier 45 is normally coupled to DC reference ground potential, while the control electrode of rectifier 45 is coupled to the junction of a voltage dividing network comprising a pair of resistors 46, 47. Resistor 46 is coupled via a conventional coin operated momentary contact switch 50 to DC power input terminal 11. A locking test switch 51 is coupled to terminal 11 and resistor 46 in parallel with switch 50 to provide an alternate energizing circuit path for relay 20 for test or servicing purposes.

When energized, relay 20 provides working DC voltage to a terminal 53 coupled to moveable blades 62, 65 of a relay 60. DC voltage is coupled via movable blade 62 and stationary contact blade 61 to an indicator lamp 68 (MAKE SELECTION) which is illuminated whenever the circuit is ready for manual selection of a tape cartridge player and a track; to a first input terminal of a second plurality of tape cartridge player selection switch members 70, 71; to the middle contact of the individual switches comprising switch block 15 described below; and to one end of a coil of a relay 80. The other end of the relay 80 coil is coupled to a plurality of normally open contact terminals of switch block 15.

DC voltage from terminal 26 is also coupled via terminal 53 to one end of the relay 60 coil, the other end of which is coupled to the anode of a silicon controlled rectifier 75. The cathode of rectifier 75 is coupled to ground DC reference potential, while the control electrode is coupled to a voltage divider network comprising a pair of resistors 76, 77. One end of resistor 77 is coupled to DC ground reference potential, and one end of resistor 76 is coupled to normally open stationary contact blade 83 of relay 80.

Switch members 70, 71 control selection of one of two conventional eight-track tape cartridge players 110, 120. Each cartridge player 110, 120 is a conventional unit, such as a Medallion Model 65-516 stereo cartridge tape player, incorporating conventional circuitry for reproducing the eight tracks recorded on a stereo cartridge. As will be appreciated by those skilled in the art, eight track stereo tape cartridges use a recording format in which eight tracks are recorded longitudinally of the tape with predetermined tracks being paired to provide left and right channel stereo signals upon reproduction. The track pairs are accessed by means of a stepping mechanism which sequentially translates the reproduction heads transversely of the longitudinal tracks in response to actuation of a track selection switch. The stepping mechanism of unit 110 comprises a solenoid 111 coupled to a mechanical member (not shown) for translating the reproduction heads a fixed amount per stepping pulse applied to the solenoid. A switch 112 is also coupled to the solenoid 111 and follows the stepping movement of the reproducing heads to sequentially contact fixed terminals 113–116, each of which is customarily coupled via a separate indicator lamp to a source of DC voltage in order to indicate the track pair currently accessed. The stepping mechanism of unit 120 is identical to that of unit 110 and comprises elements 121–126. This already provided accessing arrangement is employed in the invention in order to control the initiation of track reproduction in a manner described more fully below.

In a conventional eight track stereo tape cartridge, a conductive patch is arranged transversely of the tape to designate the end of each track. In a conventional tape player, a sensing circuit 117 is provided which customarily is used to generate a stepping pulse when the conductive patch is sensed to translate the reproducing heads to the next sequential track.

Switch member 70 includes a normally closed momentary contact switch 73 coupled in series to stationary blade 61 and movable blade 62 of relay 60, and an indicator lamp 74 coupled to ground reference potential and to stationary blade 97 of a relay 90. Switch member 71 includes a normally open momentary contact switch 75 having a first terminal coupled to stationary blade 61 of relay 60 and a second terminal coupled to a voltage divider network comprising a pair of resistors 105, 106 used to control operation of a silicon controlled rectifier 103. Switch member 71 further includes an indicator lamp 78 coupled to reference ground potential and also to stationary blade 99 of relay 90.

The coil of relay 90 is coupled at one end to the anode of silicon controlled rectifier 103 and at the other end to movable contact blade 65 of relay 60 and also to a charging capacitor 104. When switch 73 is actuated during the selection procedure, relay 90 remains in the de-energized state illustrated; when switch 75 is actuated during selection, relay 90 is energized to the opposite state by actuation of rectifier 103. Charging capacitor 104 provides a momentary holding voltage of predetermined duration during switching of relay 60 as described more fully below.

Movable contact blades 92, 95 of relay 90 are coupled to a pair of speakers 107, 108 for the right and left stereo channels, respectively. Stationary contact blades 91, 93 are coupled respectively to the RA and RB output terminals of tape players 110, 120, which are the right amplifier output terminals of these units. Stationary contact blades 94, 96 are similarly coupled to the LA and LB output terminals of units 110, 120 corresponding to the left stereo amplifier output terminals. Movable contact blade 98 is coupled to stationary contact blade 63 of relay 60 which is coupled to DC power terminal 26 via movable contact blade 62 of relay 60 during track reproduction. Fixed contact blades 97, 99 are coupled respectively to the DC voltage power input terminals 118, 128 of tape players 110, 120, and also to indicator lamps 74, 78, respectively. Movable contact blade 101 of relay 90 is coupled to AC input terminal 13. Stationary contact blades 100, 102 are coupled respectively to first and second banks of indicator lamps 141–144 and 145–148 of an illuminated card display generally designated by reference numeral 140 and described more fully below.

A relay 150 generates stepping pulses for track changing solenoids 111, 121 of tape players 110, 120 and includes a movable contact blade 152 coupled to stationary contact blade 81 of relay 80, a stationary contact blade 151 coupled to one end of the relay 150 coil and also to a charging capacitor 154, and a stationary contact blade 153 coupled to solenoid input terminals 119, 129. Capacitor 154 is coupled across relay 150 coil and the lower junction of the coil and capacitor 154 is coupled via a resistance 155 to reference ground potential. Capacitor 154 and resistance 155 form an RC charging network having a predetermined rise time for pulsing relay 150.

Switch bank assembly 15 comprises four triple-pole double throw switches 161–164 each having a first terminal 165 coupled in series to AC power input terminals 12, 13 via movable contact 166, contact terminal 167 and relay 30 coil. Switches 161–164 further include a contact terminal 168 coupled in parallel to stationary contact blade 61 of relay 60. A contact terminal 169 or each switch 161–164 is coupled in parallel to movable contact blade 82 of relay 80. Contact 170 of switches 161–164 is coupled to the corresponding lamp pair 141–148. Contact terminals 171 are coupled in parallel to one end of relay 80 coil. Contact terminals 175–178 are coupled to track access indicator terminals 179–182 of tape player unit 110 and 179′ – 182′ of tape player unit 120, respectively. If desired, contact terminals 175–178 may be coupled to either terminals 179–182 of unit 110 or terminals 179′–182′ of unit 120 since both track changing solenoids 111, 121 of units 110, 120 are operated in unison, as described more fully below.

Operation of the preferred embodiment proceeds in the following manner. With DC power applied to terminal 11 and AC power applied to terminals 12, 13, and all switches in the unactuated position, relays 20, 40, 60, 80, 90 and 150 are de-energized and relay 30 is energized as shown. DC power is applied from terminal 11 via contact blades 41, 42 to contact blade 24 and to one end of the relay 20 coil. Since rectifier 45 is initially non-conducting, relay 20 remains de-energized. AC power is applied to lock solenoid 17 via contact blades 21, 22 of de-energized relay 20 and contact blades 31, 33 of energized relay 30, energized by the AC circuit path through switch bank 15.

When a token is deposited in switch 50, DC voltage is momentarily applied from terminal 11 to the control electrode of rectifier 45 via voltage divider resistors 46, 47 and relay 20 is energized and held. Energization of relay 20 removes AC power from lock solenoid 17, thereby releasing switch bank 15 for manual operation, and also provides DC voltage to terminal 26 via contact blades 41, 42, 24 and 25. With DC voltage at terminal 26, MAKE SELECTION indicator lamp 68 is energized via terminal 53 and contact blades 61, 62, and voltage is applied to the coil of relay 60. Relay 60 remains unactuated due to the fact that rectifier 75 is non-conducting. DC voltage is also applied to one contact of switches 73, 75 via contact blades 61, 62; to capacitor 104 via the second terminal of normally closed switch 73 and contact blades 64, 65; to terminals 168 of switch bank 15; and to one end of the coil of relay 80. Relay 80 remains de-energized since the other end of the relay coil is coupled to floating reference terminals 169 of switch bank 15. The DC voltage applied to capacitor 104 charges up this capacitor to the operating voltage of the coil of relay 90, but relay 90 remains de-energized since rectifier 103 is non-conducting. The system is now ready for selection of a tape player unit and a track by operation of one of switches 73, 75 and one of switches 161–164.

If switch 73 is operated, the DC voltage to capacitor 104 is merely interrupted and relay 90 remains de-energized. The RA and LA output terminals of tape player unit 110 remain connected to speakers 107, 108 via contact blades 91, 92, 94 and 95, and AC power is applied from teriminal 13 to indicator lamps 141–144 of unit 140 via contact blades 100, 101. Lamps 141–144 remain off however, until one of switches 161–164 is operated. If switch 75 is operated, rectifier 103 is rendered conductive by the application of DC voltage to the control electrode via resistors 105, 106 and relay 90 is energized. Energization of relay 90 causes the RB and LB output terminals of tape player unit 120 to be coupled to speakers 107, 108 via contact blades 92, 93, 95 and 96; and causes AC power to be applied from terminal 13 to indicator lamps 145–148 of unit 140 via contact blades 101, 102.

Operation of one of switches 161–164 to the alternate ON position (not illustrated) opens the AC circuit path to the coil of relay 30, and relay 30 is de-energized. This conditions release solenoid 18 to be subsequently operated at the end of the reproduction cycle.

Operation of one of switches 161–164 to the ON position also completes the AC circuit for one of indicator lamps 141–148, thereby illuminating the corresponding lamp; causes the application of DC voltage to movable blade 152 of relay 150 via terminals 26, 53 contact blades 61, 62 terminal 169 of the operated one of switches 161–164, and contact blades 81, 82; and conditions relay 80 for subsequent energization by coupling the lower end of the relay 80 coil via terminal 171 of the operated switch to one of switch terminals 175–178, and thus to one of the access terminals 179–182, 179′–182′.

Application of DC voltage to relay 150 initiates the track seek process in the following manner. DC voltage is applied via contact blades 151, 152 to the charging circuit comprising capacitor 154 and resistor 155. When capacitor 154 has charged to the operating voltage of the relay 150 coil, the relay is energized, thereby applying D.C. voltage to the stepping relay input terminals 119, 129 of tape player units 110, 120. After a period of time determined by the time constant afforded by the charging circuit, capacitor 154 discharges below the sustaining voltage for the relay 150 coil, and the relay 150 de-energizes. Capacitor 154 recharges to energize relay 150 a second time and the sequential energize-de-energize operation continues until the specified track has been accessed.

As solenoids 111, 121 are sequentially operated, switches 112, 122 are sequentially stepped along terminals 113–116, and 123–126, respectively. When the position of switches 112, 122 corresponds to the track specified by the operated one of switches 161–164, a circuit path is completed from switch terminal 171 through a movable contact section to one of terminals 175–178, the corresponding one of terminals 179–182 and 179′–182′, and switches 112, 122 to ground reference potential. This causes DC current to flow through the coil of relay 80, thereby energizing relay 80. Energization of relay 80 breaks the DC circuit path to relay 150 to terminate the track access process and causes the application of DC voltage to rectifier 75 via contact blades 82, 83 and the voltage divider network comprising resistors 76, 77, thereby rendering rectifier 75 conductive. With rectifier 75 conducting, relay 60 is energized which breaks the circuit path to MAKE SELECTION lamp 68, interrupts D.C. voltage to the coil of relay 80, thereby de-energizing relay 80, removes D.C. voltage from switches 73, 75, and causes the application of DC voltage to contact blade 98 of relay 90 via contact blades 62, 63. Depending on the state of relay 90, the DC voltage present at contact blade 98 is applied to either indicator lamp 74 and tape player unit 110 or indicator lamp 78 and tape player unit 120. If tape player unit 120 has been selected by operation of switch 75 so that relay 90 is energized, capacitor 104 maintains relay 90 in the energized state during the temporary interruption of DC voltage to the coil of relay 90 caused by transfer of movable contact blade 65 from the position illustrated to a position in which contact is made with contact blade 66. With power applied to one of unit 110, 120, the track is reproduced until the conductive patch is sensed by one of sensing units 117, 127 of the operating tape player unit 110, 120.

When the conductive patch is sensed, a DC circuit path is completed from DC power input terminal 11 through the coil of relay 40 and through the sensing circuit 117 or 127 to reference ground potential. This energizes relay 40, which interrupts DC power to relay 20, causing this relay to return to the de-energized state. DC voltage is removed from terminal 26 which de-energizes relay 60; removes DC voltage from the formerly selected tape player unit 110, 120; and de-energizes relay 90 (if relay 90 was energized). With relay 20 de-energized, AC power is applied from terminals 12, 13 to INSERT COIN lamp 16 via contact blades 21, 22 and to release solenoid 18 via contact blades 32, 33 of formerly de-energized relay 30. Actuation of release solenoid 18 causes the operated one of switches 161–164 to be translated to the OFF position, which restores the AC circuit path for the coil of relay 30. Relay 30 then energizes which causes AC power to be applied from terminals 12, 13 to lock solenoid 17 via contact blades 31, 33, which mechanically locks up switch bank 15 until another coin is inserted in coin switch 50.

Figure 4:
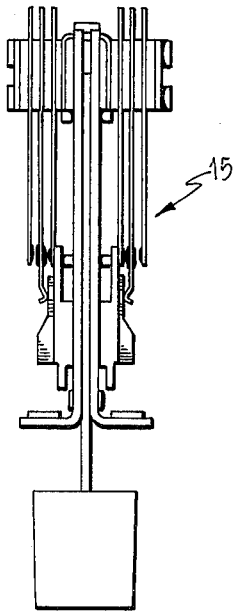
FIG. 4 is an end view taken along lines 4—4 of FIG. 3.
Figure 3:
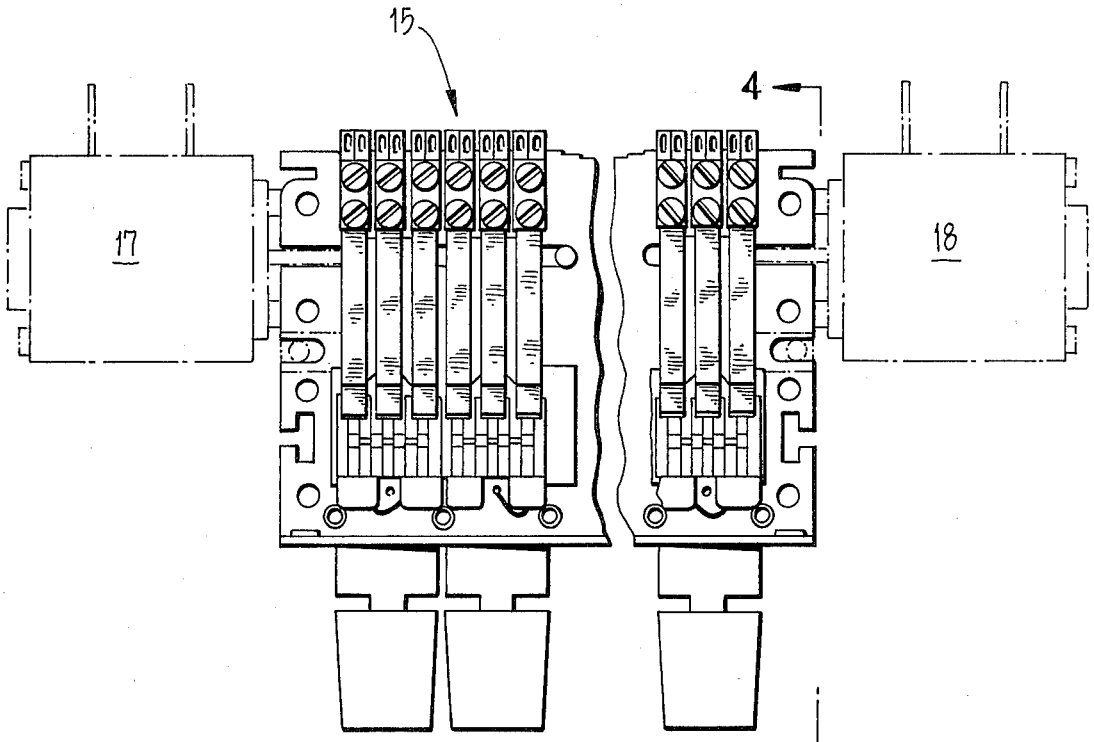
FIG. 3 is a partial top plan view of switch assembly 15.

The invention may be fabricated from conventional low-cost components which are commercially available. For example, relays 20, 40, 60, 80, 90 and 150 are all 12 volt DC relays and relay 30 is a 120 volt AC relay, all being commercially available from Potter and Brumfield Co. Silicon controlled rectifiers 45, 75 and 103 may comprise type R1101 rectifiers available from Motorola, Inc. Indicator lamps 141–148 are standard 110 volt neon lamps. Switches 50, 51 are conventional commercially available devices and switch bank 15 is a four-switch assembly of the interlock type allowing only one switch to be depressed at a time. Each switch is a triple pole double throw switch, and all switches are mounted on a common frame in operative relation with lock solenoid 17 and release solenoid 18, which are conventional AC operated solenoids. FIGS. 3 and 4 illustrate the preferred assembly and are taken after those views shown in Catalog No. S-323a of the Switchcraft Corporation.

In addition to the low cost of units fabricated in accordance with the teachings of the invention, such units are also compact in size and may be conveniently housed in a small cabinet together with tape player units 110, 120. Further, the invention permits the selection of only a single stereo track for reproduction, and any subsequent actuation of switches 73, 75 or 161–164 has no effect on the operation of the system once a particular tape player unit and track have been selected. Similarly, subsequent insertion of a coin in coin switch 50 while relay 20 is energized has no effect on the sequential operation of the system.

Figure 2:
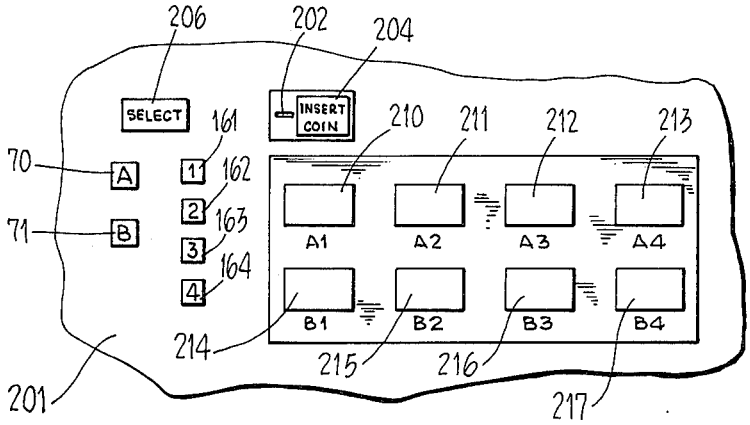
FIG. 2 is a schematic view of a control panel for the preferred embodiment.

The invention is ideally suited for use in the AUDITRON electronic auditioning system designed by the inventors and schematically depicted in FIG. 2. As seen in this Fig., a control panel 201 for a housing is provided with a coin slot 202 leading to coin switch 50 and a panel 204 which is illuminated by the insert coin light 16 and bears the legend "insert coin." Panel 201 is further provided with a panel 206 which is illuminated by the MAKE SELECTION lamp 68 and bears the legend "select." Tape player unit selector switch members 70, 71 and individual switches 161–164 are also mounted to panel 201, together with eight panels 210–217 each illuminated by indicator lamps 141–148, respectively. Panels 210–217 may be arranged in any convenient fashion to receive a photograph or transparency of a particular musical artist or group whose artistic works have been previously recorded on the stereo track corresponding to the given one of lamps 141–148.

Each photograph or transparency mounted in panels 210–217 may bear any desired information concerning the group, such as group rates, repeteroire, instrumentation and the like.

A person desiring to hire a musical artist or group for any purpose may consult the information at panels 210–217 and, if the artist or musical group appears suitable for the occasion, may operate the machine to hear representative samples of the artistic works. By locating the AUDITRON electronic auditioning system in a commercial establishment, such as a music store, or in a public location, the artist or groups represented thereby obtain wide exposure to the public and persons seeking an artist or group may conveniently audition several artists and groups with no inconvenience.

While the above provides a full and complete disclosure of the preferred embodiments of the invention, various modifications, alternate constructions and equivalents may be employed without departing from the true spirit and scope of the invention. For example, the capacity of the preferred embodiment may be expanded by adding additional tape player units and corresponding switches, if desired. In addition, individual illumination lamps may be provided for switches 161–164 to provide a visible indication of the actuation of the corresponding switch. Therefore the above description and illustrations should not be construed as limiting the scope of the invention which is defined by the appended claims.

What is claimed is:

1. For use with a multi-track tape cartridge reproducing device having circuitry for reproducing from magnetically recorded signals on a plurality of tracks equivalent electric signals in response to the application of electric power signals to a power signal input terminal, programming means for sequentially accessing different ones of said plurality of tracks for reproduction, said programming means having a control signal input terminal and a plurality of indicator terminals for indicating accessed tracks, and means for indicating the end of each of said tracks; a token operated control system for enabling manual selection of a single track for reproduction and for providing automatic termination of track reproduction at the end of a given track, said control system comprising:

first and second electrical power input terminal means;

a first plurality of manually operable switch means adapted to be coupled to said first and second electrical power input terminal means for specifying a different track for reproduction, each of said switch means having an OFF and an ON position;

seek means coupled to said first electrical power input terminal means and responsive to the operation of any one of said switch means to the ON position for generating control signals adapted to be coupled to said control signal input terminal of said programming means to sequentially access said plurality of tracks;

reproduction enable means adapted to be coupled to said programming means indicator terminals for disabling said seek means and for applying electrical power to said power signal input terminal of said reproducing device after the track specified by the operated one of said switch means has been accessed;

reset means adapted to be coupled to said track end indicating means for resetting said operated one of said switch means to the OFF position and for disabling said plurality of switch means and said reproduction enable means after the selected track has been reproduced;

token switch means for enabling said first plurality of switch means, said seek means and said reproduction enable means in response to the insertion of a predetermined token therein; and lock means coupled to said first plurality of switch means and said reset means for preventing manual operation of said first plurality of switch means when said first plurality of switch means have been disabled until a token is subsequently inserted into said token switch means.

2. The combination of claim 1 further including a plurality of track indicator lamp means each coupled to a different one of said plurality of switch means and said second electrical power input terminal means for providing a visible indication of the track specified for reproduction when the associated switch means is placed in the ON positon after being enabled by said token switch means.

3. The combination of claim 1 wherein said system further includes a second operator signal lamp means coupled to said second electrical power input terminal means via said reset means for providing an indication that said first plurality of switch means, said seek means and said reproduction enable means are disabled.

4. The combination of claim 1 wherein said seek means comprising means for generating sequential electrical stepping signals for said programming means.

5. The combination of claim 4 wherein said stepping signal generating means includes a charging circuit, and first relay means having a coil with a first end coupled to a reference potential and a second end, a movable contact blade coupled via said switch means and said reset means to said first electrical power input terminal means, a normally open stationary contact coupled to said control signal input terminal of said programming means and a normally closed stationary contact coupled to a second end of said coil and said charging circuit, said charging circuit being coupled to said second end of said coil.

6. The combination of claim 5 wherein said seek means further includes second relay means having a coil with a first end coupled via said switch means and said reset means to said first electrical power input terminal means and a second end coupled to said operated one of said switch means, a movable contact blade coupled via said operated one of said plurality of switch means and said reset means to said first electrical power input terminal means, a first stationary contact blade coupled to said movable contact blade of said first relay means, and a second stationary contact blade;

and wherein said reproduction enable means includes third relay means having a coil with a first end coupled via said reset means to said first electrical power input terminal means and a second end, a movable contact blade coupled via said reset means to said first electrical power input terminal means, a first stationary contact blade coupled to said movable contact blade of said second relay means via said operated one of said plurality of switch means and a second stationary contact blade coupled to said power signal input terminal of said reproducing device; a relay switch means having a first terminal coupled to said second end of said relay coil and a second terminal coupled to said reference potential and a control terminal coupled to said second contact blade of said second relay means.

7. The combination of claim 6 wherein said system further includes first stationary contact blade of said third relay means for providing a visible indication that said first plurality of switch means is enabled for operation.

8. The combination of claim 1 wherein said token operated control system is adapted for use with first and second multitrack tape cartridge reproducing devices of the type specified and further includes:

a second plurality of manually operated switch means for specifying operation of one of said first and second reproducing devices;

said seek means being responsive to the operation of one of each of said first and second plurality of switch means to the ON position for enabling the programming means of the selected reproducing device to sequentially access said plurality of tracks of the selected reproducing device;

said reproduction enable means including means for coupling said first electrical power input terminal means to said power signal input terminal of said selected one of said reproducing devices after the specified track has been accessed;

and said token switch means including means for enabling said second plurality of switch means in response to the insertion of said predetermined token therein.

9. The combination of claim 8 further including a plurality of track indicator lamp means each coupled to a different one of said first plurality of switch means for providing a visible indication of the track specified for reproduction when the associated switch means is placed in the ON position after being enabled by said token switch means; and a plurality of reproducing device indicator lamp means for providing a visible indication of the reproducing device specified by said second plurality of switch means.

10. The combination of claim 8 further including audio transducer means for converting said equivalent electrical signals to audible signals, said transducer means including input terminal means adapted to be coupled to said reproducing devices; and wherein said reproduction enable means includes means for coupling the equivalent electrical signals from the selected one of said reproducing devices to said input terminal means of said audio transducer means.

11. For use with a multi-track tape cartridge reproducing device having circuitry for reproducing from magnetically recorded signals on a plurality of tracks equivalent electric signals in response to the application of electric power signals to a power signal input terminal, programming means for sequentially accessing different ones of said plurality of tracks for reproduction, said programming means having a control signal input terminal and a plurality of indicator terminals for indicating accessed tracks, and means for indicating the end of each of said tracks; a token operated control system for enabling manual selection of a single track for reproduction and for providing automatic termination of track reproduction at the end of a given track, said control system comprising:

first and second electrical power input terminal means;

a plurality of manually operable switch means adapted to be coupled to said first and second electrical power input terminal means for specifying a different track for reproduction, each of said switch means having an OFF and an ON position;

seek means coupled to said first electrical power input terminal means and responsive to the operation of any one of said switch means to the ON position for generating control signals adapted to be coupled to said control signal input terminal of said programming means to sequentially access said plurality of tracks, said seek means including means for generating sequential electrical stepping signals for said programming means, said stepping signal generating means having a charging circuit, and first relay means having a coil with a first end coupled to a reference potential and a second end, a movable contact blade coupled via said switch means and said reproduction enable means to said first electrical power input terminal means, a normally open stationary contact coupled to said control signal input terminal of said programming means and a normally closed stationary contact coupled to a second end of said coil and said charging circuit, said charging circuit being coupled to said second end of said coil;

reproduction enable means adapted to be coupled to said programming means indicator terminals for disabling said seek means and for applying electrical power to said power signal input terminal of said reproducing device after the track specified by the operated one of said switch means has been accessed;

reset means adapted to be coupled to said track end indicating means for resetting said operated one of said switch means to the OFF position and for disabling said plurality of switch means and said reproduction enable means after the selected track has been reproduced; and token switch means for enabling said plurality of switch means, said seek means and said reproduction enable means in response to the insertion of a predetermined token therein.

* * * * *